US006474250B1

(12) United States Patent
Penterson et al.

(10) Patent No.: US 6,474,250 B1
(45) Date of Patent: Nov. 5, 2002

(54) NOZZLE ASSEMBLY FOR A PULVERIZED COAL BURNER

(75) Inventors: Craig A. Penterson, Sutton, MA (US); Richard J. Dube, Billerica, MA (US); Bonnie Courtemanche, Holden, MA (US)

(73) Assignee: Babcock Borsig Power, Inc., Worcester, MA (US)

( * ) Notice: Subject to any disclaimer, the term of this patent is extended or adjusted under 35 U.S.C. 154(b) by 0 days.

(21) Appl. No.: 09/864,645

(22) Filed: May 24, 2001

(51) Int. Cl.[7] ..... F23C 1/10; F23C 1/12
(52) U.S. Cl. ..... 110/261; 110/264
(58) Field of Search ..... 110/261, 263, 110/264, 265; 431/186

(56) References Cited

U.S. PATENT DOCUMENTS 4,457,241 A 7/1984 Itse et al.
4,479,241 A 10/1984 Itse et al.
4,517,904 A 5/1985 Penterson et al.
4,611,543 A * 9/1986 Collette ..... 110/263
5,231,937 A * 8/1993 Kobayashi et al. ..... 110/262
5,588,380 A * 12/1996 LaRose et al. ..... 110/263
5,937,770 A * 8/1999 Kobayashi et al. ..... 110/263
6,112,676 A * 9/2000 Okazaki et al. ..... 110/261
6,145,764 A * 11/2000 Gonzalez et al. ..... 239/587.6
6,189,464 B1 * 2/2001 Okazaki et al. ..... 110/347
6,237,510 B1 * 5/2001 Tsumura et al. ..... 110/262

* cited by examiner

*Primary Examiner*—Ira S. Lazarus
*Assistant Examiner*—K. B. Rinehart
(74) *Attorney, Agent, or Firm*—Greer, Burns & Crain, Ltd.; Phillip M. Kolehmainen

(57) ABSTRACT

A mixture of pulverized coal and primary air travels axially through a tubular nozzle body having an outlet end in and surrounded by axially flowing concentric streams of secondary and often tertiary air. In the nozzle body, the coal/air mixture flows through a venturi that concentrates the coal in a fuel rich central zone. The coal/air mixture then flows through a spreader that imparts a swirling motion to the mixture and divides the mixture into multiple discrete lobes or streams. At the outlet end of the nozzle body, a flame stabilizer ring produces a separation zone between the coal/air mixture exiting the nozzle body and the surrounding flow of secondary air. The flame stabilizer ring includes an outwardly flared skirt section that spreads the secondary air flow and inwardly directed teeth that extend into the streams of coal/air mixture flowing from the nozzle body outlet.

9 Claims, 3 Drawing Sheets

NOZZLE ASSEMBLY FOR A PULVERIZED COAL BURNER

FIELD OF THE INVENTION

The present invention relates to an improved burner nozzle assembly for a pulverized coal burner, and more particularly to a nozzle assembly that promotes fuel rich combustion and reduces the formation of nitrogen oxide emissions.

DESCRIPTION OF THE PRIOR ART

Many burner configurations have been designed for burning pulverized coal. A problem confronted by such designs is to reduce the production of oxides of nitrogen (NOx) in the combustion process.

U.S. Pat. Nos. 4,479,442 and 4,457,241 disclose a dual air zone, controlled combustion venturi, pulverized coal burner assembly used with front or opposed fired utility boilers to provide low NOx combustion. U.S. Pat. No. 4,517,904 discloses a tertiary staged venturi burner system for reducing NOx emissions from turbo furnace type steam generators. Although the burner assemblies disclosed in these patents have achieved success in providing pulverized coal combustion with low levels of NOx, it would be desirable to provide an improved nozzle assembly for use in these and other burner systems that provides even greater NOx reduction.

SUMMARY OF THE INVENTION

A principal object of the present invention is to provide an improved pulverized coal burner nozzle assembly. Other objects are to provide a pulverized coal burner nozzle assembly that promotes fuel rich combustion and reduces the formation of nitrogen oxides; and to provide a pulverized coal burner nozzle assembly that provides an improvement over known burner assemblies.

In brief, in accordance with the invention there is provided a nozzle assembly for use in a pulverized coal burner of the type wherein the nozzle assembly discharges into a surrounding stream of axially flowing air. The nozzle assembly includes an elongated tubular nozzle body having a central longitudinal axis and axially spaced inlet and outlet ends. A coal/air supply introduces a flowing mass of pulverized coal and primary air into the inlet end of the nozzle body for axial flow through the nozzle body to the outlet end. A venturi in the nozzle body between the inlet and outlet ends concentrates the flow of pulverized coal and primary air at the center of the nozzle tube and creates a fuel rich central region,. The venturi includes an upstream converging wall section and a restricted venturi throat. A spreader in the nozzle body between the venturi throat and the outlet end includes a plurality of swirl vanes inclined relative to the axis for imparting a swirling motion to the flow of pulverized coal and primary air. A flow stabilizer mounted at the outlet end of the nozzle body includes a first portion extending radially outward from the nozzle body into the surrounding air stream for deflecting the air stream away from the axis. The stabilizer includes a second portion extending radially inward from the nozzle body into the swirling flow of pulverized coal and primary air.

BRIEF DESCRIPTION OF THE DRAWING

The present invention together with the above and other objects and advantages may best be understood from the following detailed description of the preferred embodiment of the invention illustrated in the drawings, wherein.

DETAILED DESCRIPTION OF THE PREFERRED EMBODIMENTS

Figure 1:
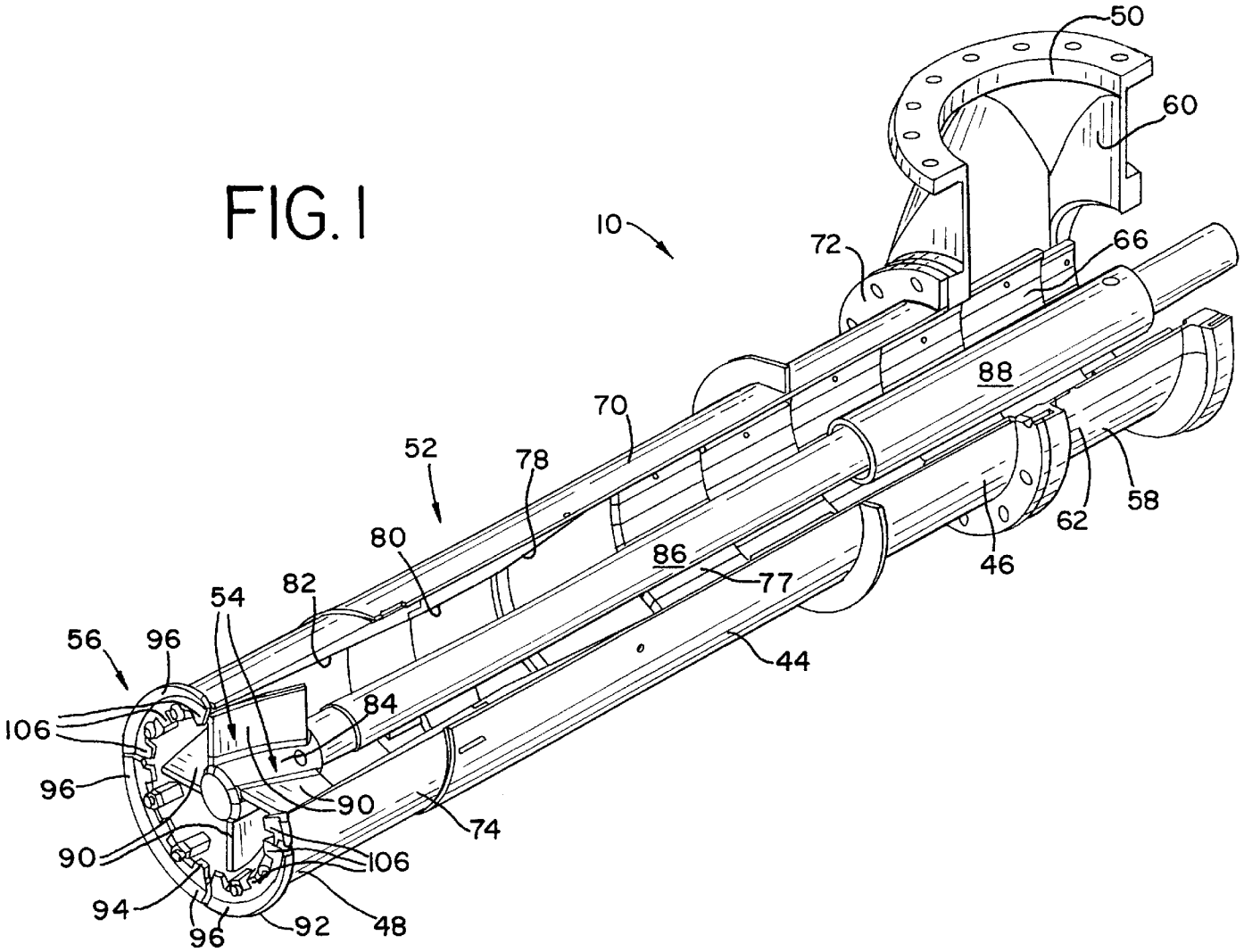
FIG. 1 is an isometric view, partly broken away, of a burner nozzle assembly for pulverized coal in accordance with the present invention.
Figure 2:
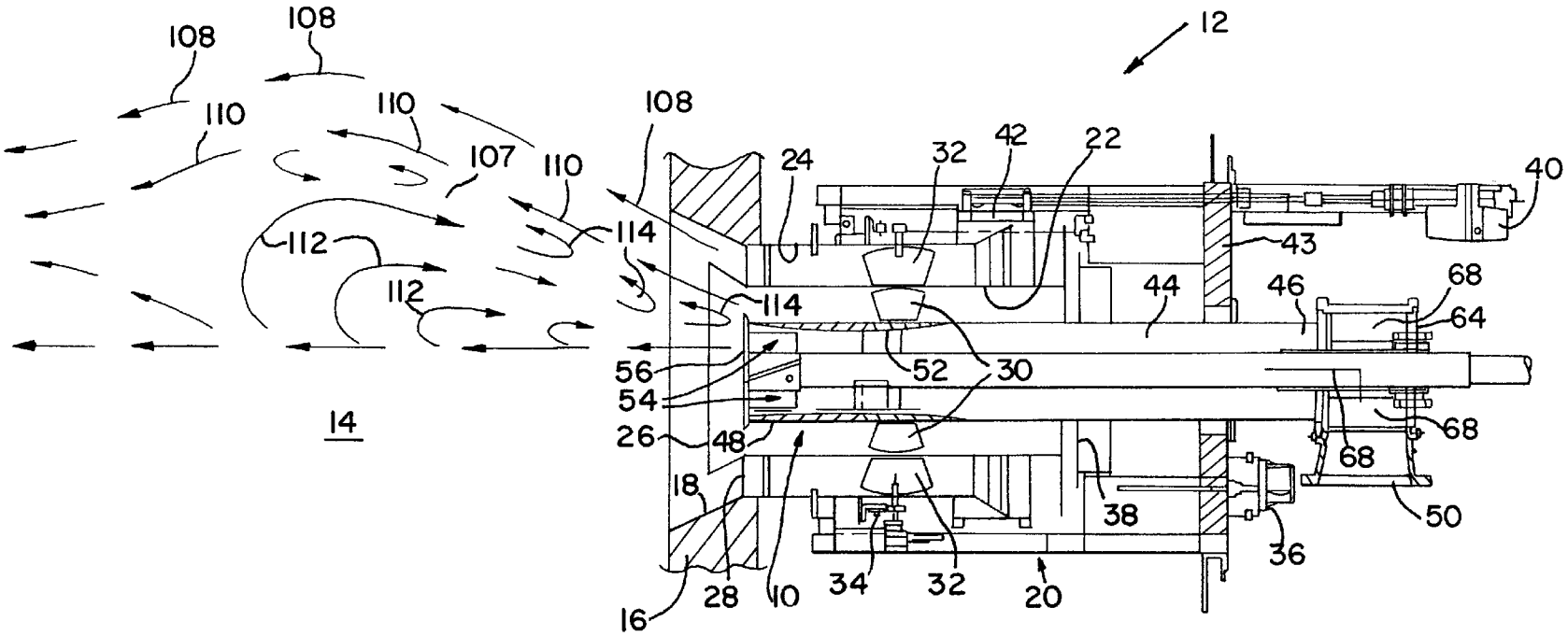
FIG. 2 is an axial sectional view of a burner assembly including the burner nozzle assembly of claim 1, together with flow arrows showing the flow pattern produced in a furnace combustion region by the burner assembly and burner nozzle assembly.

Having reference now to the drawings, FIG. 1 illustrates a burner nozzle assembly generally designated as 10 and constructed in accordance with the principles of the present invention. The nozzle assembly 10 is used in burner assemblies of the type wherein the outlet of the nozzle assembly is in a stream of air such as secondary air or secondary and tertiary air. The nozzle assembly 10 is seen in FIG. 2 with a controlled combustion venturi burner assembly generally designated as 12. The nozzle assembly 10 can also be used with other types of burner assemblies.

The burner assembly 12 of FIG. 2 supplies a combustible fuel-air mixture into a combustion area 14 defined within a burner wall 16 through a frusto-conical burner throat 18. The burner assembly 12 has a air ducting system 20 including generally tubular, telescoped secondary and tertiary air ducts 22 and 24. The secondary air duct 22 has a flared outlet 26 located within the burner throat 18. The tertiary air duct 24 surrounds the secondary air duct 22 and has an outlet 28 coinciding with the burner throat 18. The flared secondary air outlet 26 is located within the tertiary air duct outlet 28 and diverts the tertiary air flow in an inclined, radially outward direction as it enters the combustion area 14.

Swirling motion is imparted to secondary air flowing through the secondary air duct 22 by fixed swirl vanes 30 located in the secondary air flow path. Similarly, swirling motion is imparted to tertiary air flowing through the tertiary air duct 24 by adjustable swirl vanes 32 located in the tertiary air flow path. A tertiary air swirl adjustment mechanism 34 is operated by a tertiary air actuator 36 to tailor the tertiary air swirling motion to the requirements of a specific furnace application. If desired, the swirl vanes 30 for the secondary air flow could also be adjustable in a similar manner.

The volume of secondary air flowing through the secondary air duct 22 is determined by the position of a secondary air control damper 38. The volume of tertiary air flowing through the tertiary air duct 24 is adjustable by operating a tertiary air shroud actuator 40 in order to move a tertiary air flow control shroud 42. The tertiary air actuator 36 and the tertiary air shroud actuator 40 are located in an accessible position outside of a burner front wall 43. A further description of the controlled combustion venturi burner assembly 12 beyond that needed for a complete understanding of the present invention can be found in U.S. Pat. No. 4,479,442, incorporated herein by reference. The burner nozzle assembly 10 can also be used with the tertiary staged venturi burner system disclosed in U.S. Pat. No. 4,517,904, incorporated herein by reference.

The burner nozzle assembly 10 is illustrated in FIG. 1. Nozzle assembly 10 includes an elongated tubular nozzle body 44 extending in an axial direction from an inlet end 46 to an outlet end 48. A coal/air supply port 50 introduces pulverized coal and primary air into the nozzle body adjacent the inlet end 46, and the coal/air mixture flows axially from the inlet end 46 to the outlet end 48. As it moves along this flow path, in accordance with the present invention, the coal/air mixture flows through a venturi 52, through a spreader 54 and through a flame stabilizer 56 as described in more detail below.

The burner assembly 12 is used in a furnace system including coal pulverizers that deliver a slurry or mixture of coal and primary air to the supply port 50. The supply port 50 is part of a coal head 58 having an entry leg 60 generally perpendicular to the axis of the nozzle body 44 and an axial portion 62 aligned with and attached to the inlet end of the nozzle body 44. The upstream end of the axial portion 62 is closed by an end wall 64 seen in FIG. 2. Resistance to abrasion by pulverized coal is provided by a ceramic tile lining 66 in the axial portion 62. Vanes 68 (FIG. 2) may be used to guide the entering coal/air stream into the burner nozzle body 44 and produce a uniform, homogeneous mixture of primary air and coal.

The nozzle body 44 is preferably a right circular cylindrical tube with a main section 70 having a flange 72 bolted to the axial coal head portion 62 and a nozzle tip portion 74 attached to the forward end of the main section 70. The outlet end 48 of the nozzle body 44 is a circular edge 76 (FIG. 4) and is located within the flared outlet 26 of the secondary air duct 22 (FIG. 2). Abrasion resistance can be provided by a lining 77 of ceramic tiles in the main section 70.

As the coal/air mixture moves axially through the nozzle assembly 12 toward the outlet end 48, the mixture travels through the venturi 52. The venturi 52 includes a frustoconical, converging entry wall section 78 leading to a restricted venturi throat 80 having a diameter smaller than the diameter of the remainder of the nozzle body 44. A diverging exit wall section 82 extends from the throat 80 to the nozzle body outlet end 48. The venturi 52 concentrates the coal in the traveling coal/air mixture toward the center of the coal nozzle, creating a fuel-rich center core.

After it leaves the venturi throat 80, the coal/air mixture with the fuel-rich center core passes through the spreader 54. The spreader 54 includes a central hub 84 carried by a spreader support tube 86 extending axially to the rear of the of the burner nozzle assembly. As seen in FIG. 2, the support tube 86 extends rearward through the end wall 64 of the coal head, and can be manipulated to adjust the position of the spreader 54 for optimum performance. A sleeve 88 protects the tube 86 from abrasion.

Inclined swirl vanes 90 extend outward from the hub 84 and produce a moderate swirling motion of the coal/air mixture. The vanes 90 are located within the diverging wall section 82 and extend to or near the surface of the wall section 82 in order to divide the single entering coal/air stream into multiple, distinct swirling concentrated lobes or coal streams exiting the nozzle body 44. The multiple coal streams leaving the spreader 54 enter the furnace combustion area 14 in a gradual helical pattern, assisting control of the location and size of the primary ignition zone, flame length, and combustion characteristics of the burner assembly 10.

To ensure that primary ignition and pyrolysis of the multiple coal streams occur in a localized reducing environment, the flame stabilizer 56 is mounted at the coal nozzle outlet end 48. The outlet end 48 is located in and surrounded by the axially flowing secondary air and tertiary air streams entering the combustion area 14 from the flared secondary air outlet 26 and from the burner throat 18. The flame stabilizer 56 includes a first portion 92 that extends radially outward from the nozzle body 44 into the surrounding stream of air. The flame stabilizer 56 also includes a second portion 94 that extends radially inward into the path of the multiple coal/air streams exiting the spreader 54.

Figure 3:
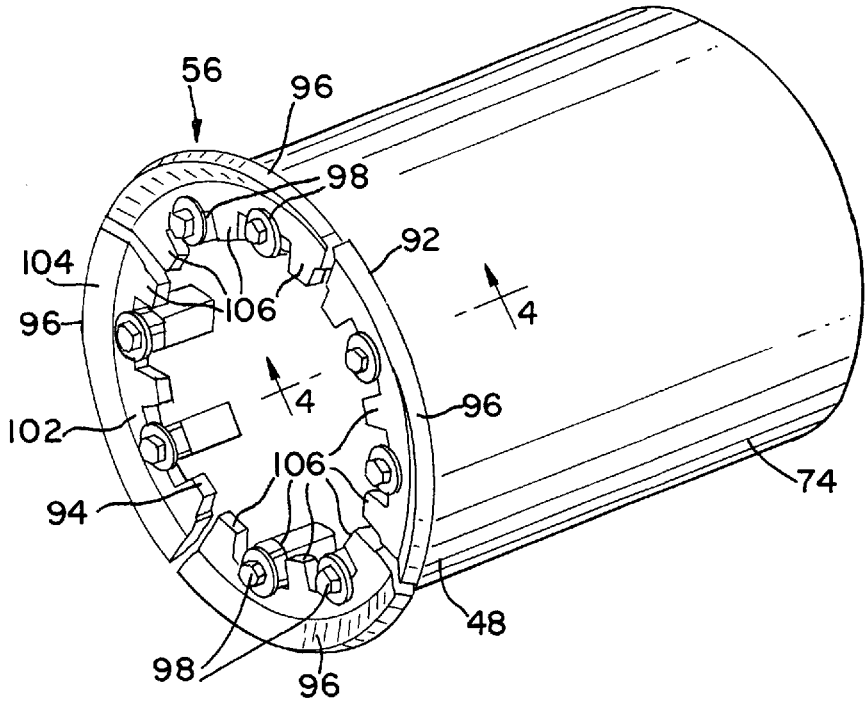
FIG. 3 is an enlarged isometric view showing the outlet end of the nozzle body and the flame stabilizer of the burner nozzle assembly.
Figure 4:
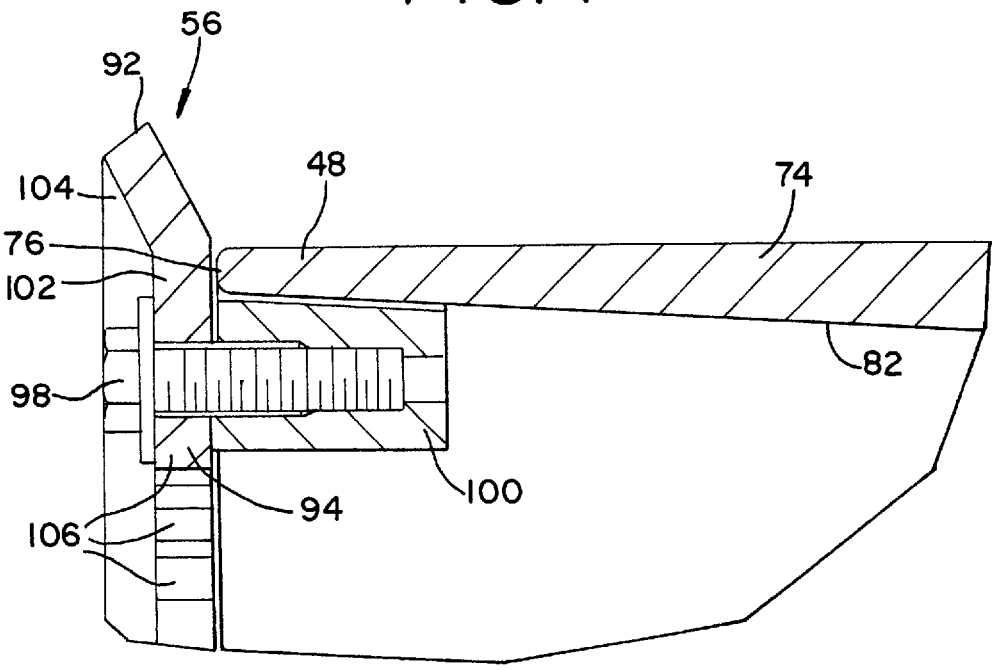
FIG. 4 is an enlarged cross sectional view taken along the line 4—4 of FIG. 3.

More specifically, in the preferred arrangement, the flame stabilizer 56 is preferably a ring attached to the outlet end 48 of the nozzle body tip portion 74. To simplify fabrication, the ring is segmented, with four quadrant sections 96 seen in FIG. 3. Each section is fastened by bolts 98 to lugs 100 welded to the interior of the nozzle body tip portion 74 at the circular edge 76. The flame stabilizer ring 56 includes a circular base ring section 102 . The first portion 92 extending into the surrounding air stream is a flared skirt section 104 that extends outward beyond the periphery of the coal nozzle body 44 into the secondary air flow path at an angle to the burner axis of more than 45 degrees. As seen in FIG. 4, the skirt section is flared at about 60 degrees. The second flame stabilization portion 94 takes the form of multiple teeth 106 protruding radially inwardly into the outlet of the burner nozzle body 44.

The flame stabilizer ring 56 produces a distinct separation zone 107 between the primary air/coal mixture and the flow of secondary air. The separation effect is illustrated by flow arrows seen in FIG. 2. The effect is symmetrical about the central axis of the nozzle assembly 12, and arrows are shown in only one half of the ignition zone in the furnace combustion area 14. The pattern in the other half is similar. Arrows 108 illustrate the smooth, flared boundary region provided by tertiary air flow. Arrows 110 illustrate the secondary air flow within the tertiary air flow, and show the radially outward spreading effect that is imparted to the secondary air flow by the skirt section 102 of the flame stabilizer 56.

The improved pulverized coal combustion characteristics achieved with the burner nozzle assembly 12 of the present invention reduce undesirable NOx emissions released to the surrounding environment from utility boilers and furnaces. The separation zone 107 created by the flame stabilizer 56 is within the flared secondary air flow path shown by arrows 110. Within this separation zone 107 created by the flame stabilizer 56, as shown in FIG. 2, hot combustion products recirculate back to the nozzle tip in a primary internal recirculation zone near the coal nozzle. This recirculation is indicated by arrows 112. The flow patterns then reverse flow direction back downstream and mix with secondary air in a secondary recirculation zone adjacent to the secondary air stream from the burner. The mixing reverse flow is indicated by arrows 114.

The primary internal recirculation zone creates a secondary ignition zone along the primary air/coal stream leaving the coal nozzle. This ensures that hot combustion products from the primary ignition zone are brought back to the burner discharge around the periphery of the nozzle outlet end 48 to create flame attachment and separation of the primary air/coal from the secondary air. The combustion and hot combustion products in the primary internal recirculation zone adjacent to the nozzle tip heat the incoming coal and primary air streams and create conditions for proper ignition, pyrolysis, and stability of the low NOx coal flame. Because the venturi 52 in the nozzle body 44 concentrates the larger-sized coal particles toward the center of the coal/air stream, only the finer, smaller coal particles flow over the flame stabilizing ring 56. This envelope of smaller coal particles enhances ignition and pyrolysis of the pulverized coal stream While the present invention has been described with reference to the details of the embodiment of the invention shown in the drawing, these details are not intended to limit the scope of the invention as claimed in the appended claims.

What is claimed is:

1. A nozzle assembly for use in a pulverized coal burner of the type wherein the nozzle assembly discharges into a surrounding stream of axially flowing air, the nozzle assembly comprising:

an elongated tubular nozzle body having a central longitudinal axis and axially spaced inlet and outlet ends;

a coal/air supply introducing a flowing mass of pulverized coal and primary air into said inlet end of said nozzle body for axial flow through said nozzle body to said outlet end;

a venturi in said nozzle body between said inlet and outlet ends for concentrating the flow of pulverized coal and primary air at the center of said nozzle tube and creating a fuel rich central region, said venturi including an upstream converging wall section and a restricted venturi throat;

a spreader in said nozzle body between said venturi throat and said outlet end, said spreader including a plurality of swirl vanes inclined relative to said axis for imparting a swirling motion to the flow of pulverized coal and primary air;

a flow stabilizer mounted at said outlet end of said nozzle body;

said stabilizer including a first portion extending radially outward from said nozzle body into the surrounding air stream for deflecting the air stream away from said axis; and said stabilizer including a second portion extending radially inward from the nozzle body into the swirling flow of pulverized coal and primary air said outlet end of said nozzle body comprising a circular edge, said stabilizer comprising a ring mounted at said circular edge, said ring comprising a plurality of discrete ring segments connected to said nozzle body; and a plurality of lugs attached to the inner surface of said nozzle body adjacent said circular edge, said ring segments being fastened to said lugs.

2. A nozzle assembly as claimed in claim 1, said venturi including a diverging wall portion extending from said venturi throat to said outlet end, said spreader being located within said diverging wall portion.

3. A nozzle assembly as claimed in claim 2, said spreader including a central hub located at said axis, said swirl vanes extending from said central hub toward said diverging wall portion for dividing the flow of pulverized coal and primary air into a plurality of helically flowing stream segments.

4. A nozzle assembly as claimed in claim 1, said coal/air supply including a coal head having an entry leg extending at an angle relative to said axis and communicating with said nozzle body adjacent said inlet end, and a ceramic liner disposed at the intersection of said coal head and said nozzle body.

5. A nozzle assembly as claimed in claim 1, said first portion of said stabilizer comprising a flared skirt portion extending radially outwardly at an inclined angle from said circular edge.

6. A nozzle assembly as claimed in claim 5, said skirt portion being flared outwardly at an angle of more than forty-five degrees from the axis of said nozzle body.

7. A nozzle assembly as claimed in claim 6, said skirt portion being flared outwardly at an angle of about sixty degrees from the axis of said nozzle body.

8. A nozzle assembly as claimed in claim 1, said second portion of said stabilizer comprising an annular wall lying in a plane perpendicular to said axis.

9. A nozzle assembly as claimed in claim 7, said wall having circumferentially spaced teeth extending radially inwardly from said circular edge toward said axis.

* * * * *